US008851542B2

(12) United States Patent
Faraone

(10) Patent No.: US 8,851,542 B2
(45) Date of Patent: Oct. 7, 2014

(54) PORTABLE BAG HOLDER AND KIT

(71) Applicant: Ideas for Product Design, Chicago, IL (US)

(72) Inventor: Rosemarie Faraone, Chicago, IL (US)

(73) Assignee: Ideas for Product Designs, Chicago, IL (US)

( * ) Notice: Subject to any disclaimer, the term of this patent is extended or adjusted under 35 U.S.C. 154(b) by 0 days.

(21) Appl. No.: 13/745,484

(22) Filed: Jan. 18, 2013

(65) Prior Publication Data

US 2013/0343677 A1 Dec. 26, 2013

Related U.S. Application Data

(60) Provisional application No. 61/662,222, filed on Jun. 20, 2012.

(51) Int. Cl.

| | |
|---|---|
| ***B66F 19/00*** | (2006.01) |
| ***E01H 1/12*** | (2006.01) |
| ***B65B 67/12*** | (2006.01) |
| ***B65F 1/14*** | (2006.01) |
| ***B65F 1/10*** | (2006.01) |
| ***A47L 13/52*** | (2006.01) |

(52) U.S. Cl.

CPC *B65B 67/12* (2013.01); *E01H 1/12* (2013.01); *B65F 1/1415* (2013.01); *B65B 67/1238* (2013.01); *E01H 2001/1293* (2013.01); *B65F 1/10* (2013.01); *A47L 13/52* (2013.01)

USPC ..... 294/214; 15/257.1; 248/99

(58) Field of Classification Search

USPC ..... 294/214, 1.4, 1.5; 15/257.1, 257.3; 248/99, 101

See application file for complete search history.

(56) References Cited

U.S. PATENT DOCUMENTS

| | | | | | |
|---|---|---|---|---|---|
| D263,512 | S | * | 3/1982 | Kawada | D30/162 |
| 4,457,549 | A | | 7/1984 | Lowery | |
| 4,723,803 | A | * | 2/1988 | Sapp | 294/214 |
| 4,759,519 | A | | 7/1988 | Cheng | |
| 4,783,090 | A | | 11/1988 | Moulton | |
| 4,832,291 | A | * | 5/1989 | Nelson et al. | 248/99 |
| 5,000,406 | A | | 3/1991 | Petersen | |
| 5,031,948 | A | | 7/1991 | Groth et al. | |
| 5,131,704 | A | * | 7/1992 | Li | 294/1.4 |
| 5,180,125 | A | | 1/1993 | Caveney | |
| 5,899,510 | A | * | 5/1999 | Hayes et al. | 294/1.4 |

(Continued)

FOREIGN PATENT DOCUMENTS

GB 2 422 361 A 7/2006

OTHER PUBLICATIONS

Pop-up Garden Bag, http://www.alibaba.com/product-gs/521213890/pop_up_garden_bag.html.

(Continued)

*Primary Examiner* — Saul Rodridguez
*Assistant Examiner* — Gabriela Puig
(74) *Attorney, Agent, or Firm* — Winston & Strawn LLP

(57) ABSTRACT

A portable bag holder, kit and method are provided for maintaining a bag mouth of a disposable bag in an open position. The portable bag mouth holder may be provided in combination with one or a plurality of receptacles such that the bag mouth is maintained in an open position of contents in the bag.

16 Claims, 6 Drawing Sheets

(56) References Cited

U.S. PATENT DOCUMENTS

| | | | | |
|---|---|---|---|---|
| 5,947,602 | A | 9/1999 | Coxsey | |
| 6,276,645 | B1 | 8/2001 | Chang | |
| 7,007,991 | B1 * | 3/2006 | Sapp | 294/214 |
| 7,011,278 | B1 | 3/2006 | Baldwin, III | |
| 7,080,863 | B2 * | 7/2006 | Cappellano et al. | 294/1.4 |
| 8,267,358 | B1 | 9/2012 | Letson | |
| 2002/0021012 | A1 * | 2/2002 | Roye | 294/1.1 |
| 2005/0056649 | A1 | 3/2005 | Simonson | |
| 2005/0178931 | A1 | 8/2005 | Tomlin | |
| 2006/0152023 | A1 * | 7/2006 | Owens, III | 294/1.1 |
| 2008/0265592 | A1 * | 10/2008 | Askinasi | 294/1.4 |
| 2009/0134644 | A1 * | 5/2009 | Roberts | 294/1.4 |
| 2010/0117387 | A1 * | 5/2010 | Axelrod | 294/1.4 |
| 2011/0147545 | A1 | 6/2011 | Faraone | |
| 2013/0313378 | A1 * | 11/2013 | Gonzales, II | 248/101 |
| 2014/0062109 | A1 * | 3/2014 | Olivera | 294/1.5 |

OTHER PUBLICATIONS

International Search Report and Written Opinion, Appl. No. PCT/US2013/046137, Sep. 3, 2013.

* cited by examiner

PORTABLE BAG HOLDER AND KIT

FIELD OF INVENTION

The present invention is directed to a portable bag holder and kit for collecting contents such as refuse, yard waste, recyclables and construction debris. In particular, the invention is directed to a device that maintains a disposable bag in at least a partially open position during use.

BACKGROUND OF THE INVENTION

When using disposable bags, it is usually difficult to perform other simultaneous functions while trying to keep the mouth of the bag open. Without containers or stands to serve as scaffolds, the current unstructured mouth openings of polymeric and other commercially available bags collapse while performing tasks such as collecting waste, raking leaves and picking up trash and recycling. When one attempts to load the bag with contents (such as leaves, refuse, debris, recyclables and other objects), some contents may miss the bag opening and end up on the ground or floor. This process is frustrating in that it requires duplicate efforts along with potential physical discomfort incurred by bending, lifting and carrying the objects for disposal in the bag as well as transport of the bag itself to a disposal bin, recycling bin or comparable receptacle (collectively "disposal bins").

One solution is to simply use one hand for placing the debris into the bag while using the other hand to hold the bag open. This may not be an effective approach when the bag is empty, as two hands are often required to hold the bag open. Consequently, if only a small handful of contents may be lifted and placed in the bag at one time, the job will take much longer than if both hands could be used. To prevent objects from dropping back to the floor or ground, some people will hold the bag in a horizontal position, rather than vertically upright. In this position, the bag mouth generally does not stay open, making it difficult to also sweep or rake objects into the bag. Again, the solution is generally to hold the bag open with one hand while sweeping or raking with the other hand. Using the bag in this manner can be very inefficient, since users are constantly stopping to try to hold the bag open with one hand and loading the bag with the other.

Various attempts have been made to provide portable devices that are workable with a single hand and that hold bags open in at least a partially open position, particularly during the performance of tasks that require incorporation of contents into the bags for eventual transport and/or disposal. U.S. Pat. No. 4,457,549 to Lowery provides an example of a bag mouth holder that includes a frame having longitudinally spaced clamps for releasably clamping portions of a bag mouth extending through the frame. The frame includes an elongate handle and support foot structure so that the frame may be positioned on the ground in a freely upstanding position with the bag opening in a horizontal direction.

U.S. Pat. No. 4,759,519 to Cheng provides another example of a portable bag mouth holder in which a generally rectangular frame is provided with a handle selectively attached thereto. One side of the frame has leg means to support the frame in an upright standing position, and opposing side portions of the frame are adjustable lengthwise to accommodate bags of various sizes. Clip elements are provided near the frame's four corners for attaching the bags to the frame.

U.S. Pat. No. 6,276,645 to Chang also provides an example of a portable bag mouth holder that includes a rigid frame with a pair of parallel side bars having a handle at one end.

Free ends of the side bars are mounted to a lower supporting platform bar. A slider bar is slidably mounted on the side bars and located between the handle and the lower supporting platform bar. Both the slider bar and the supporting platform bar have a horizontal U-shaped channel. A flexible bag can be mounted to the device by wrapping two opposite sides of the bag's lip portion on two securement bars and inserting the wrapped securement bars into the U-shaped channels, thereby securing the bag to the device. The slide is pushed upward to maintain the bag in an open position and may be adjusted to accommodate bags of different sizes.

U.S. Pat. No. 7,011,278 to Baldwin, III provides an additional example of a portable bag mouth holder in which parallel handles are gripped and squeezed together in one hand, thereby compressing a spring and repositioning a small section of frame near a large frame loop. While the handles are gripped, the loop is placed within the mouth of a bag, and the top of the mouth of the bag is placed over the small frame with the other hand. Releasing the handles correspondingly releases compression from the spring and moves the small frame away from the frame loop. The mouth of the bag is thereby tensioned around the large loop and the small frame to maintain the mouth of the bag in an open position.

Despite these known methods and devices, a need persisted for improved bag holders that avoid inherent disadvantages in the prior art in facilitating one-handed operation of a bag holder while maintaining a disposable bag in at least a partially open position. This need was initially addressed by providing a portable bag holder that maintains the mouth of a bag in an at least partial open position to receive contents therein, as disclosed in U.S. patent application publication 20110147545. The present invention provides additional attributes over the prior application by providing a portable bag holder and kit for use with one hand during execution of a variety of tasks.

SUMMARY OF THE INVENTION

A portable bag mouth holder is provided that maintains a bag mouth of a disposable bag in an open position. The portable bag holder includes a handle having an elongate body depending therefrom and terminating in a bag mouth engaging portion for maintaining the bag mouth in the open position. The bag mouth engaging portion includes a frame that assists in maintaining the bag mouth in the open position for receiving contents therein. The bag mouth is removable from the bag mouth engaging portion to permit bag disposal after the contents are placed in the bag and to allow re-use of the bag mouth engaging portion on another bag. Also, in use, the handle allows manipulation and placement of the holder and bag in any one of a plurality of positions to facilitate placing contents into the bag.

The frame of the bag mouth engaging portion may be a receptacle comprising a top of predetermined length, a bottom of predetermined length that exceeds the top length to facilitate guiding of the contents into the bag and opposing sides of predetermined height joined by opposed open ends; wherein the top, bottom and sides are joined to form front and rear open ends of the receptacle with the bag mouth surrounding one of the open ends of the receptacle for receipt of the contents into the bag. The receptacle may include structure for releasable engagement with at least a portion of the bag mouth, the structure selected from one or more apertures provided in the receptacle, or one or more grooves provided near one of the open ends of the receptacle along at least one or more of the top, bottom and sides thereof. The receptacle may optionally include a foldable flap to facilitate entry of contents into the bag when at least part of the bag mouth is in the open position.

Then, to secure the bag to the portable bag holder, the bag can be provided with a drawstring having first and second ends and a length exceeding a periphery of the bag mouth, and wherein the drawstring is releasably engageable with an open end of the receptacle to retain the bag mouth in the open position.

The frame of the bag mouth engaging portion may instead be a loop frame having a handle engaging portion proximate the elongate body of the handle and an opposed collection portion with opposed side portions intermediate the handle engaging portion and the collection portion. The handle engaging portion, the collection portion and side portions together delineate an ingress for receipt of the contents. In some embodiments that include the loop frame, at least one latch is in releasable engagement with each frame side portion, with each latch being configured and dimensioned to retain at least a portion of the bag mouth and the opposing sides of the receptacle. The latches are closable to retain at least the opposing sides of the receptacle with the bag mouth in the open position to receive contents in the bag via the receptacle. The latches are also openable to allow disposal of at least one of the receptacle and the bag after contents are placed in at least one of the receptacle and bag. This configuration permits re-use of the latch on at least one of another receptacle and another bag. Each open end of the receptacle corresponds to the ingress of the loop frame.

With some embodiments, the bag can include a drawstring having first and second ends and a length exceeding a periphery of the bag mouth. The drawstring is releasably engageable with an open end of the receptacle and further engageable with the groove to retain the bag mouth in the open position. In some embodiments, the elongate body includes drawstring securing structure that releasably secures at least part of the drawstring to allow disposal of at least one of the receptacle and the bag after contents are placed in at least one of the receptacle and bag. Such embodiments allow the holder to be re-used with another bag. The drawstring securing structure may be selected from at least one of a primary aperture defined along the elongate body, one or more protrusions provided adjacent the primary aperture and one or more secondary apertures configured and dimensioned to receive at least part of the drawstring or the bag mouth when either the drawstring or the bag mouth is pulled therethrough.

The portable bag mouth holder may be provided in combination with a plurality of receptacles, with each receptacle having a top of predetermined length, a bottom of predetermined length that exceeds the top length and opposing sides of predetermined height joined by opposed open ends. In exemplary combinations, at least one receptacle includes structure for releasable engagement with at least a portion of the bag mouth, and an optional foldable flap that facilitates entry of contents into the bag. In such combinations, the frame may be selected from at least a receptacle selected from the plurality of receptacles and a loop frame as heretofore described.

A kit for holding a disposable bag open is provided that includes components for forming a portable bag mouth holder and optionally one or a plurality of bags of the same or different sizes. The bags are sized to be compatible with the frame. The kit may optionally include a plurality of handles of different sizes and/or adjustable length.

A method for holding a disposable bag open is provided that includes providing a portable bag mouth holder as heretofore described. The method also includes securing at least part of the bag mouth of a disposable bag with the bag mouth engaging portion so as to maintain the bag mouth in the open position for receiving contents in the bag. The bag mouth is removable from the bag mouth engaging portion to permit bag disposal after contents are placed therein and to allow re-use of the bag mouth engaging portion on another bag. Optionally, the portable bag mouth holder and one or a plurality of receptacles may be provided in a kit.

In one embodiment of the method, the frame comprises a receptacle, the disposable bags include a drawstring and the disposable bags are secured to the frame by the drawstring. In another embodiment, the frame is a loop frame a loop frame having a handle engaging portion proximate the elongate body of the handle and the disposable bags are secured to the frame by a drawstring.

Other aspects of the presently disclosed invention will become readily apparent from the following detailed description.

BRIEF DESCRIPTION OF THE DRAWINGS

The nature and various advantages of the present invention will become more apparent upon consideration of the following detailed description, taken in conjunction with the accompanying drawings, in which like reference characters refer to like parts throughout, and in which.

DETAILED DESCRIPTION OF THE INVENTION

Figure 2:
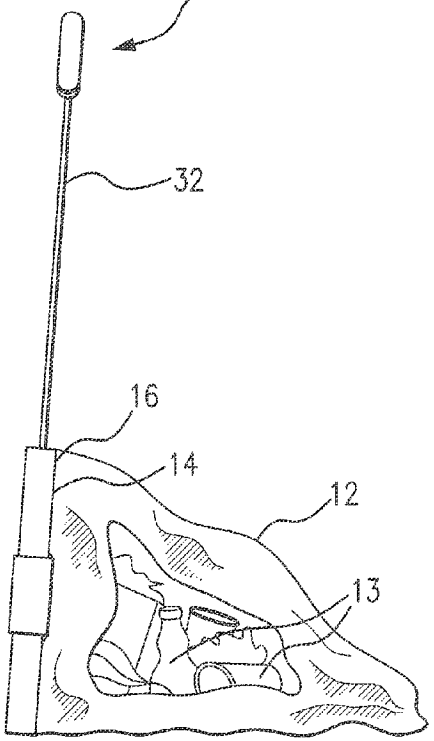
FIG. 2 is a side view of the portable bag holder of FIG. 1 having a disposable, flexible bag in communication therewith.
Figure 1:
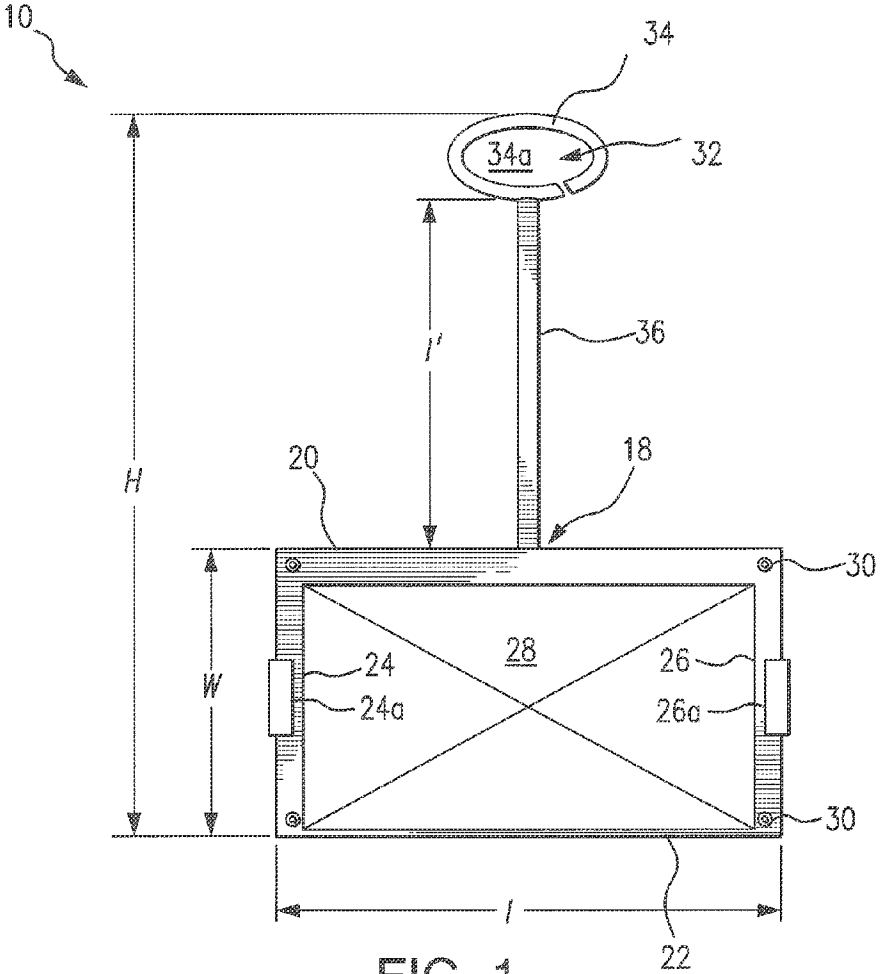
FIG. 1 is a front view of an exemplary portable bag holder of the present invention.

Now referring to the figures, wherein like numbers represent like elements, an exemplary embodiment of a portable bag holder 10 is provided in FIGS. 1 and 2. Portable bag holder 10 holds a disposable bag 12 having an opening 14 that defines a bag mouth 16. Bag 12 is fabricated from a flexible material such as a polymeric, fabric or composite material that is amenable to low-cost manufacture of bag 12 in various sizes, volumes, colors and quantities. Various configurations of bag 12 are well known in the art to accommodate contents 13 therewithin, wherein contents 13 include a plurality of object types (including but not limited to debris, refuse, equipment, clothing, leaves and grass, recyclables and the like).

As further described hereinbelow, portable bag holder 10 includes a handle having an elongate body depending therefrom and terminating in a bag mouth engaging portion for maintaining the bag mouth in an open position. The bag mouth engaging portion includes a loop frame 18 having a handle engaging portion 20, an opposed collection portion 22 and interposed side portions 24, 26. Handle engaging portion 20, collection portion 22 and side portions 24, 26 together delineate an ingress 28 having an entry area for receipt of contents into bag as further described hereinbelow.

As shown in FIGS. 1 and 2, loop frame 18 has a generally rectangular geometry with handle engaging portion 20 and collection portion 22 each having a length l and side portions 24, 26 each having a width w. Although portable bag holder 10 is shown having a generally rectangular geometry, it is understood that any geometry may be employed that is amenable to successful practice of the disclosed invention. For example, handle engaging portion 20 may have a length different from that of connection portion 22 to facilitate use of loop frame 18 with disposable bags of varying volumes. In an embodiment where portions of loop frame 18 are adjustable as described hereinabove, un overall portable bag holder height H may be correspondingly adjustable.

Loop frame 18 may comprise an integral member or may alternatively comprise two or more detachably engageable members as shown in FIG. 1. In the latter configuration, handle engaging portion 20, collection portion 22 and side portions 24, 26 engage one another by snap-tight engagement. Such engagement may be effected by known engagement means including snaps 30 provided along at least portions of loop frame 18. Although snaps 30 are shown at corner areas of loop frame 18, additional snaps may be provided along other areas of handle engaging portion 20, collection portion 22 and side portions 24, 26 to facilitate adjustment of the entry area of ingress 18. It is understood that the handle engaging, collection and side portions may alternatively engage one another by other engagement means, including but not limited to notch and recess engagement, frictional engagement, epoxy and any complement and equivalent thereof.

Figure 3:
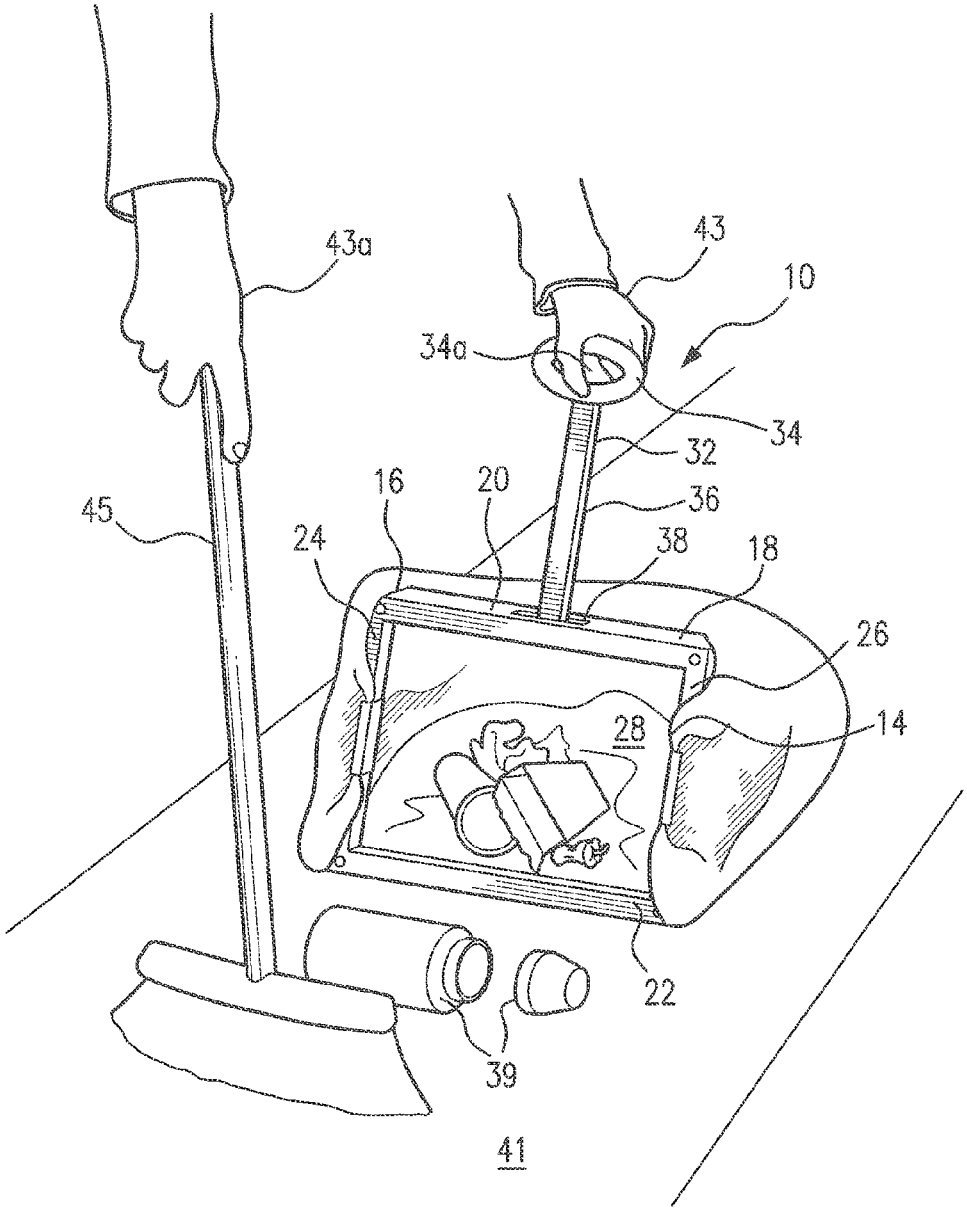
FIG. 3 is a front perspective view of the portable bag holder of FIGS. 1 and 2 during Use.

Referring again to FIGS. 1 and 2 and further to FIG. 3, a handle 32 is provided that may be integral with handle engaging portion 20. Handle 32 may include a grasping portion 34 having at least a partial opening 34*a* to allow grasping by a user or hanging of portable bag holder 10 from a support. As shown in FIGS. 1 and 3, grasping portion 34 may comprise at least a partially closed loop. An elongate portion 36 having a length l is disposed intermediate, and may be integral with at least one of grasping portion 34 of handle 32 and handle engaging portion 20 of loop frame 18. Elongate portion 36 together with side portions 24, 26 delineate an overall portable bag holder height H. Elongate portion 36 may comprise intussusceptable members (not shown) that are engageable in any one of a plurality of lockable positions to provide a selective handle length and correspondingly provide a selectable overall portable bag holder height H. Additional configurations of handle 32 that are amenable to practice with the present invention are fully described in Applicant's co-pending application U.S. Ser. No. 12/964,615, Publication no. U.S. 2011/0147545 A1, the entire disclosure of which is incorporated by reference herein.

Handle 32 may detachably engage loop frame 18 at handle engaging portion 20, for instance, by threading though a complementary slit 38 in the handle engaging portion (see FIG. 3). Any means may be selected for detachable engagement of handle 32 with handle engaging portion 20, including but not limited to threaded engagement, frictional engagement, snap-tight engagement, notch and recess engagement, epoxy and any complement and equivalent thereof. Although handle 32 is shown as being disposed midway along handle engaging portion 20, it is understood that handle 32 may be selectively engageable along any portion of handle engaging portion 20 as would be understood by a person of ordinary skill in the art. It is also understood that more than one handle may be detachably engaged with handle engaging portion 20 to facilitate different size loop frames, contents of varying weight and geometry and users of varying strength. For instance, while a construction worker working alone may be able to easily lift loop frame 18 and its bagged contents using a single handle, a senior citizen or disabled individual working alone or with a partner may require at least two handles to transport loop frame 18 along with bag 12 and its contents. In addition, smaller frames are contemplated for use by teams of people of varying statures, including children, who may work in pairs to transport loop frame 18.

Each side portion 24, 26 is provided with a respective latch 24*a*, 26*a* in releasable engagement therewith. Each latch 24*a*, 26*a* is configured and dimensioned to retain at least part of bag mouth 16 thereby and may resiliently clasp a respective side portion 24, 26 to ensure retention of the latch thereon. Each latch 24*a*, 26*a* may be an essentially elongate U-shaped member that engages bag mouth 16 such that at least a portion of the bag mouth is retained intermediate latch 24*a*, 26*a* and respective side portion 24, 26. Latches 24*a*, 26*a* may engage side portions via snap-fit engagement and/or may be fabricated from a resilient material such that each latch has an integral pivot hinge portion facilitating placement and removal of the latches relative to bag 12 and side portions 24, 26. Each latch 24*a*, 26*a* is closable to retain bag mouth 16 at least partially open to receive contents 13 therein via ingress 28. Each latch is likewise openable to allow disposal of bag 12 after contents 13 are placed therein and to allow latches 24*a*, 26*a* to be re-used on another bag. Each frame side portion 24, 26 may include an aperture (not shown) that accommodates detachable engagement of a corresponding latch 24*a*, 26*a* therethrough. Each latch can thereby retain at least a portion of bag mouth 16 through a corresponding aperture when the bag mouth is putted around a periphery of loop frame 18 and engaged by each latch.

Referring further to FIG. 3, portable bag holder 10 is shown in use while sweeping debris 39 from a sidewalk 41. Sweeping debris 39 comprises an exemplary task during which portable bag holder 10 retains a disposable bag in at least a partial open position during use, and many other uses are contemplated. As shown in FIG. 3, bag mouth 16 is pulled around a periphery of loop frame 18 and engaged by each latch 24*a*, 26*a*, While a ser's hand 43 holds grasping portion 34 of handle 32, the same user grips a broom 45 in the other hand 43*a* to sweep debris 39 through ingress 28 and into bag 12. It is understood that at least collection portion 22 of loop frame 18 may have sufficient thickness to support loop frame 18 independently, thereby obviating the need for a user to grip handle 32.

Figure 5:
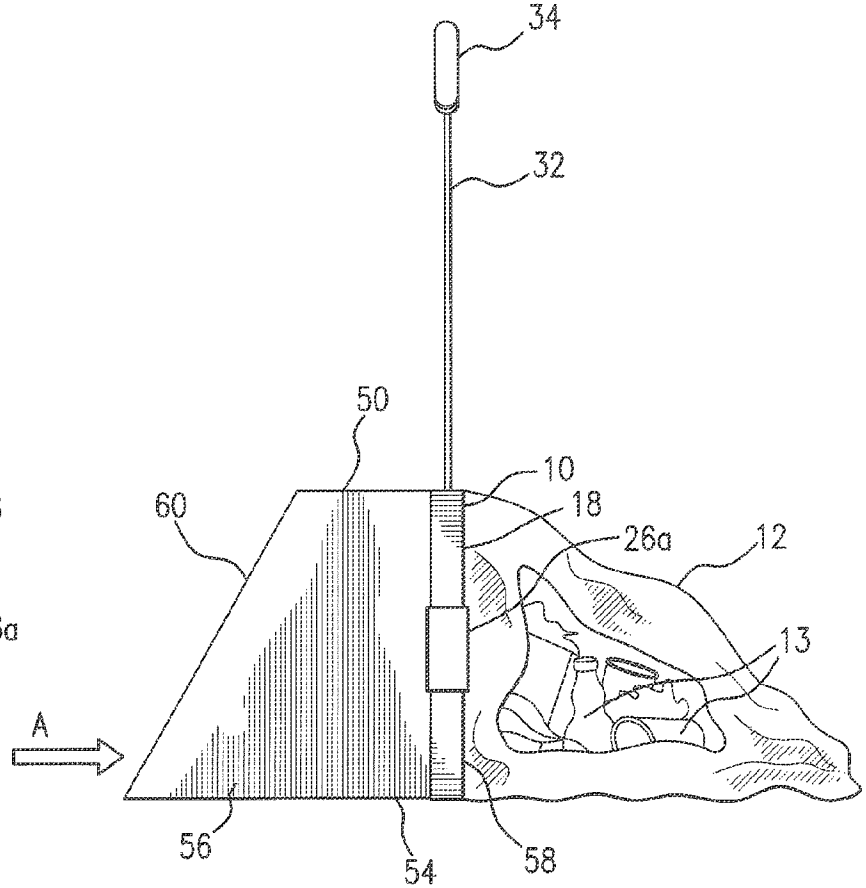
FIGS. 5, 6 and 7 are side views of the exemplary combination of FIG. 4 with the portable bag holder in releasable engagement with the receptacle and a disposable bag.
Figure 4:
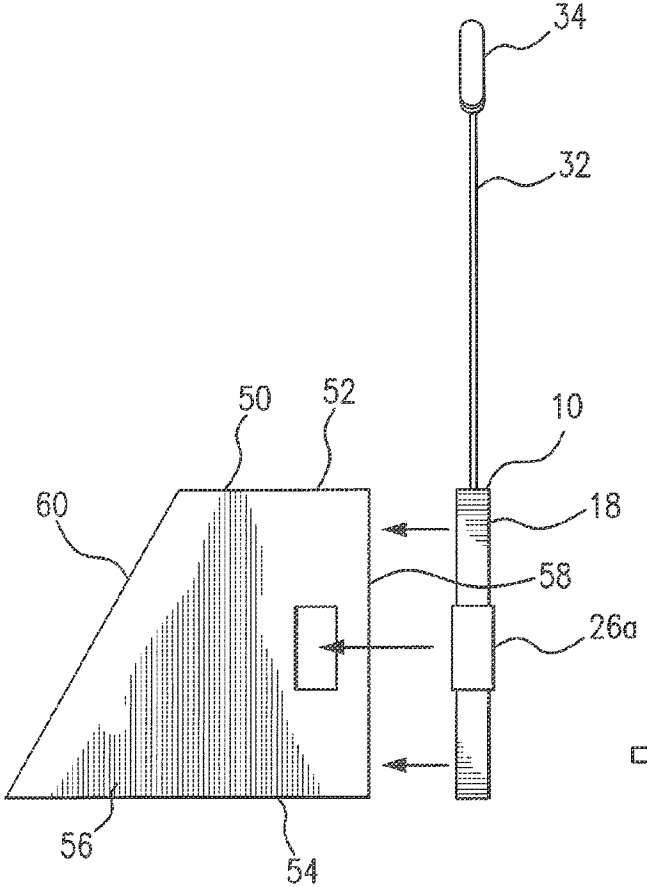
FIG. 4 is a side view of the portable bag holder of FIG. 1 in combination with an exemplary receptacle prior to engagement therewith.

Now referring to FIGS. 4 and 5 (and with like elements designated by like numbers), loop frame 18 may be provided in combination with at least one receptacle 50 having a top 52, a bottom 54 and opposing sides 56 joined by opposed open ends 58 and 60. Open ends 58 and 60 delineate a passage area generally corresponding to the entry area of ingress 28 to provide an unimpeded conduit for delivery of contents through receptacle 50 to bag 12. Receptacle 50 is shown as a generally polygonal structure, although it is understood that receptacle 50 may comprise any geometry that is amenable to successful practice of the present invention.

At least one receptacle side 56 may have an aperture for releasable engagement by a corresponding latch of loop frame 18 (shown in FIG. 4 as latch 26*a*). When combining receptacle 50 with loop frame 18, one of open ends 58 and 60 is selectively disposed adjacent ingress 28 for receiving contents 13 in bag 12 when bag mouth 16 is pulled around a periphery of loop frame 18 and engaged by latches 24*a*, 26*a*. Each latch retains a respective receptacle side portion 56 and at least a portion of bag mouth 16 thereby with bag 12 being configured relative to loop frame 18 to retain at least a portion of receptacle 50 and contents 13.

Figure 7:
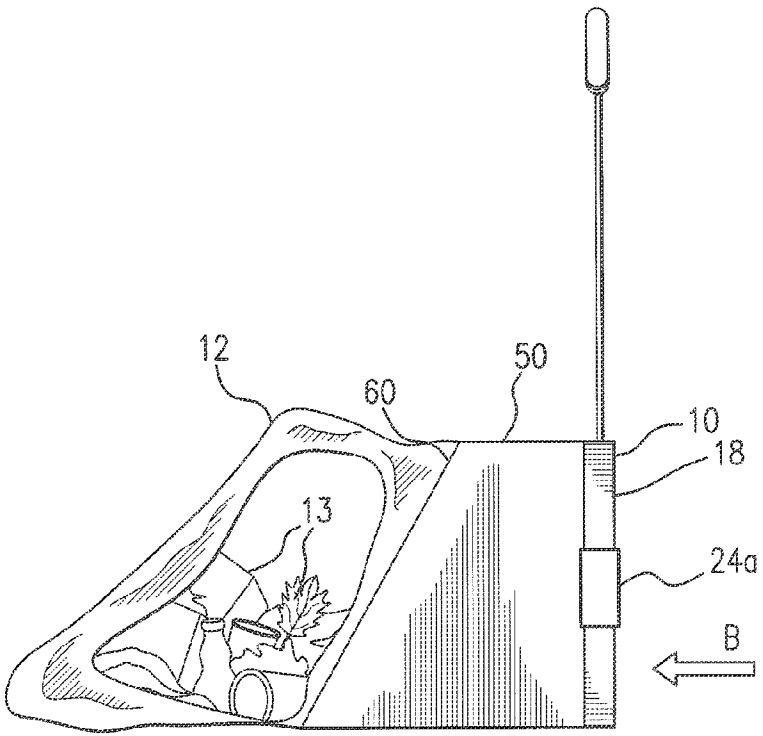
Figure 6:
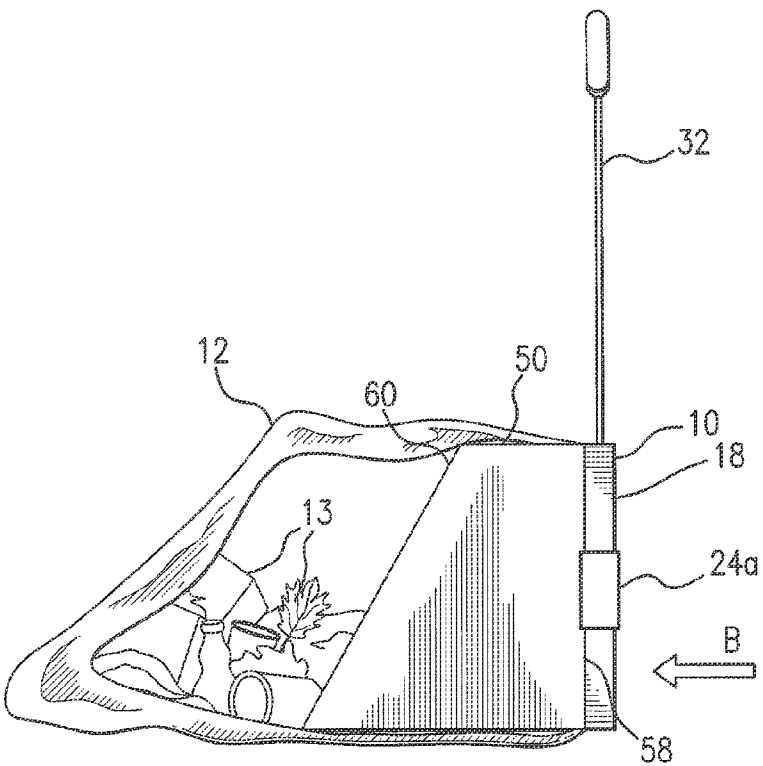

In an exemplary combination, FIG. 5 shows loop frame 18 engaging receptacle 50 and bag 12 at receptacle open end 58 so that additional contents may enter opposed receptacle open end 60 in the direction of arrow A. Contents 13 pass through receptacle 50 and receptacle open end 58 through ingress 28 for deposit in bag 12. In other exemplary combinations, FIGS. 6 and 7 show loop frame 18 engaging receptacle 50 at opposed receptacle open end 60 so that contents 13 may enter receptacle open end 58 in the direction of arrow B. FIG. 6 shows bag 12 enveloping an entirety of receptacle 50, and FIG. 7 shows bag 12 engaged at open end 58 and passing through receptacle 50. In the examples shown in FIGS. 6 and 7, contents traverse an extent of receptacle 50 for unimpeded delivery to bag 12. In all of these examples, latches 24*a*, 26*a* are closable to retain receptacle side portions 56 with bag mouth 16 at least partially open to receive contents 13 via receptacle 50. Latches 24*a*, 26*a* are likewise openable to allow disposal of at least one of receptacle 50 and bag 12 after contents 13 are placed in at least one of the receptacle and the bag. Latches 24*a*, 26*a* may be later re-used on at least one of another receptacle and another bag.

Figure 8:
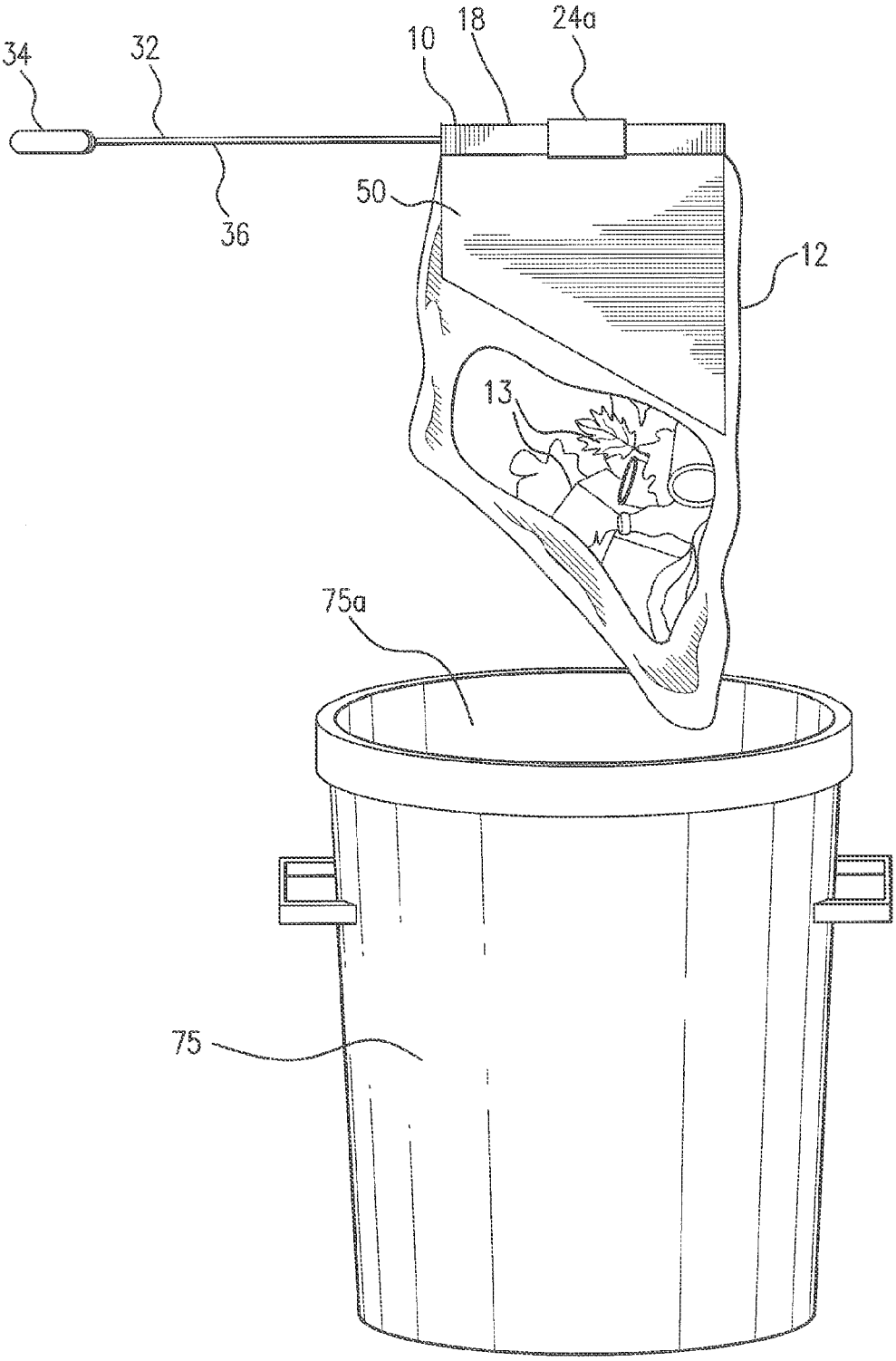
FIG. 8 is a front perspective view of the combination of FIG. 6 in use with a disposal bin.

Referring to FIG. 8, portable bag holder 10 having bag 12 full of contents is easily transported for ready delivery to a disposal bin 75 for disposal of bag 12 and contents 13 thereinto. FIG. 8 shows the exemplary combination of FIG. 6, although it is understood portable bag holder 10 may be used alone or in any other combination as disclosed herein to deposit contents in disposal bin 75. Disposal bin 75 may be a standard trashcan, industrial dumpster, a recycling bin, a clothes collection bin or any other container that can receive bag 12 and its contents. Disposal bin 75 need not be limited to containers for refuse or other unwanted materials but may also be a storage container (e.g., a bin for holiday decorations or seasonal clothes that accommodates one or more bags 12 and permits easy access to the user). A user may easily grip any part of grasping portion 34 and/or elongate portion 36 of handle 32 and elevate bag 12 above disposal bin 75 (or otherwise position bag 12 relative to disposal bin 75 to allow release of the bag into the bin). It is contemplated that loop frame 18 may be supported by disposal bin at open end 75*a* thereof so that opening of latches 24*a*, 26*a* readily deposits receptacle 50 and bag 12 along with contents 13 in disposal bin 75. When the combination of FIG. 5 or FIG. 7 is employed, loop frame 18 may be supported by disposal bin 75 such that bag 12 with contents 13 is deposited into the disposal bin and receptacle 50 is released from engagement with loop frame 18 for re-use.

Figure 9:
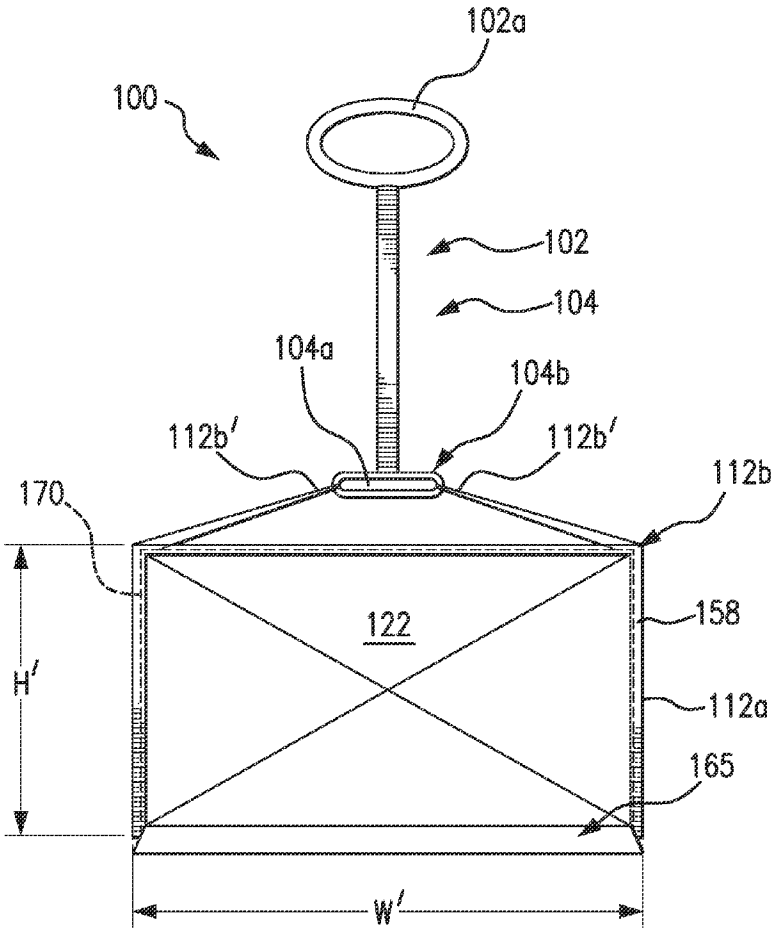
FIG. 9 is a front view of another exemplary portable bag holder of the present invention.

Referring to FIG. 9, another exemplary embodiment of a portable bag holder is provided. Portable bag holder 100 includes a handle 102 having an elongate body 104 depending therefrom. In some embodiments, handle 102 is a generally annular member having a grasping member 102*a* by which a user may grasp the handle. Handle 102 may optionally include an open slot (not shown) so that the handle may be removably attached to a hook, doorknob, post or other support. Although grasping member 102*a* is shown as a generally annular member with an aperture therethrough, grasping member 102*a* may comprise any geometry amenable to manipulation of portable bag holder 100 and placement of the holder in a plurality of positions to receive contents in a disposable bag 122.

Handle 102 may be integral with elongate body 104 or may detachably engage the elongate body as would be understood by a person of ordinary skill in the art (e.g., by threaded engagement, frictional engagement, snap-tight engagement, notch and recess engagement, epoxy and any complement and equivalent thereof). Elongate body 104 may comprise intussusceptable members (not shown) that are engageable in any one of a plurality of lockable positions to provide a selective handle length.

Figure 10:
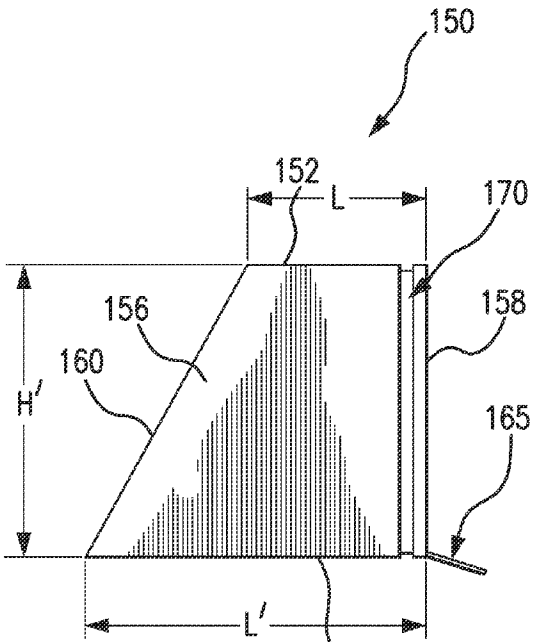
FIG. 10 is a side view of another exemplary receptacle used with the portable bag holders of FIGS. 1 and 9

Elongate body 104 terminates in a bag mouth engaging portion for maintaining disposable bag 112 in an open position so that bag mouth readily receives contents therein (see FIG. 9). In some embodiments, the bag mouth engaging portion includes a receptacle 150 having a top 152 of predetermined length L, a bottom 154 of predetermined length L' that exceeds the top length L and opposing sides 156 of predetermined height joined by opposed open ends 158, 160 (see FIG. 10). At least one open end of receptacle 150 has a predetermined width W'. As shown in FIG. 10, in use, bag mouth 112*a* surrounds at least one open end of the receptacle for receipt of the contents in the bag (not shown). Receptacle 150 optionally includes a foldable flap 165 that facilitates entry of contents into bag 112 when bag mouth 112*a* is in the open position.

Receptacle 150 may include structure for releasable engagement with at least a portion of bag mouth 112*a*. As shown in FIG. 10, such structure may include a groove 170 provided adjacent at least one open end 158 of receptacle 150 and along at least one of receptacle top 152, receptacle bottom 154 and opposing sides 156. When receptacle 150 is fitted within bag mouth 112*a*, groove 170 impedes slippage of the receptacle from within the bag such that bag mouth 112*a* remains in an open position. This exemplary structure for releasable engagement may be complemented or substituted by an aperture provided in at least one opposing side 156 of receptacle 150, as shown and described with respect to receptacle 50 hereinabove. Likewise, receptacle 150 as shown in FIG. 10 may be used with loop frame 18 as heretofore described.

In some embodiments, bag 112 may include a drawstring 112*b* having first and second ends 112*b*' and a length that is longer than a periphery of bag mouth 112*a* (see FIG. 9). Drawstring 112*b* is releasably engageable with an open end 158, 160 of receptacle 150. Drawstring 112*b* is further engageable with groove 170 to ensure that bag mouth it 12*a* remains in the open position while holder 100 is in use.

In some embodiments of holder 100, elongate body 104 includes structure for securing bag mouth 112*a* to holder 100 via drawstring 112*b*. Such structure may include a primary aperture 104*a* defined in the elongate body. As shown in the exemplary embodiment of FIG. 9, aperture 104*a* is delineated in a symmetrical tab 104*b*, although a person of ordinary skill in the art would understand that a plurality of configurations are amenable to provision of aperture 104*a* therein. Aperture 104*a* is configured and dimensioned to receive at least part of drawstring 112*b* thereby, although it is contemplated that aperture 104*a* may also be configured and dimensioned to receive at least part of bag mouth 112*a* when at least one of drawstring 112*b* and bag mouth 112*a* is pulled therethrough. In an embodiment where holder 100 is used with receptacle 150, aperture 104*a* releasably secures drawstring 112*b* thereby and groove 170 releasably engages bag mouth 112*a*, thereby retaining bag mouth 112*a* in the open position for receipt of contents in bag 112 via receptacle 150. Drawstring 112*b* is releasable from primary aperture 104*a* to allow disposal of at least one of receptacle 150 and bag 112*a* after contents are placed in at least one of the receptacle and bag. Holder 100 with aperture 104*a* may thereafter be re-used with another bag.

In other embodiments, structure for securing bag mouth 112*a* to holder 100 via drawstring 112*b* may include at least one protrusion (not shown) provided adjacent primary aperture 104*a* around which at least a portion of bag mouth 112*a* is secured to retain the bag mouth in the open position. In still other embodiments, structure for securing bag mouth 112*a* to holder 100 to retain the bag mouth in the open position via drawstring 112*b* may include one or more secondary apertures (not shown) configured and dimensioned to receive at least one of drawstring 112*b* and bag mouth 112*a* when at least one of the drawstring and bag mouth is pulled therethrough.

Multiple receptacles and multiple bags may be included in a kit along with one or more variations of a frame selected from at least one or more variations of loop frame 18 and one or more receptacles 50 and 150. Such a kit may include various components for forming a loop frame 18 such as handle engaging portions 20, collection portions 22 and side portions 24, 26 of varying dimensions to accommodate a variety of bag volumes. Optionally, one or a plurality of bags of the same or different size, material and/or color may be included in the kit that are all compatible with ingress 28 of loop frame 18 (or alternatively compatible with portable bag holder 100). Optionally, a plurality of handles of different sizes and functionality may be included with such a kit. Such handles may be interchangeable with one or more variations of loop frame 18. They also may have adjustable lengths provided by different members that can be connected to each other at different positions. Additionally, a plurality of receptacles of varying sizes and geometries may optionally be provided with such a kit. This breadth of selection can accommodate various situations. For example, in communities where local regulations dictate disposal of recyclable materials, such a kit may incorporate bags of varying colors and sizes corresponding to specified recyclable materials large blue plastic bags for plastic recyclables, medium yellow bags for paper recyclables, large-to-medium green plastic bags for leaves and compost, small-to-medium white plastic bags for general waste products, etc.). Such bag selections can include one or more bags having drawstrings as heretofore described. In another example, such a kit can accommodate commercial and industrial uses where receptacles of varying sizes eliminate large plastic and metal waste containers and facilitate quick and easy removal of commercial byproducts (e.g., to more easily facilitate OSHA and other regulatory compliance).

Any of loop frame 18, handle 32 and latches 24*a*, 26*a*, along with any of handle 102 and elongate body 104, may be fabricated from plastic, although other fabrication materials may be employed, including but not limited to composites, fiber-based alloys and any combination and equivalent thereof. It is advantageous to select lightweight materials that are sufficiently strong to hold the bag as disclosed herein. Receptacles 50 and 150 may also be fabricated from plastic to facilitate repeated use of the receptacle. Construction of receptacles 50 and 150 from cardboard or other fibrous material can facilitate easy disposal of the receptacle along with any debris collected therewith.

It is understood that the present invention portable bag holder additionally simplifies transport and removal of contents from a bag in addition to facilitating single-handed introduction of contents into the bag. A bag having contents therein may be combined with at least one of loop frame 18 (and optionally receptacle 50) and one of portable bag holder 100 (and receptacle 150) to transport the contents from an original location to a destination location. At the destination location, the bag mouth remains open for easy removal of the contents from the bag. For example, this function may be desirable for sports and recreational equipment wherein only some articles of equipment are required at any one time. All of the necessary equipment can be easily transported while only the equipment that is currently required is easily removed and replaced in the bag for the duration of a recreational activity.

The present invention portable bag holder and kit is successfully employable in a variety of tasks that benefit from a bag holder that is workable with a single hand. In residential use, the disclosed portable bag holder and kit may be used in many tasks, including but not limited to storage, landscape cleanup, year-round weather-related cleanup, patio and deck cleanup, driveway and walkway cleanup, transport of landscaping materials and retrieval and transport of recyclables. In commercial and municipal use, the present invention is amenable to successful use in activities including, but not limited to, beach and park cleanup, construction cleanup, stadium cleanup and disaster cleanup. When used for construction work, the portable bag holder can reduce labor-related injuries by eliminating back injuries attributable to bending and repetitive stress injuries attributable to repetitive fining of disposable bags Any dimensions and values disclosed herein are not to be understood as being strictly limited to the exact numerical values recited. Instead, unless otherwise specified, each such dimension is intended to mean both the recited value and a functionally equivalent range surrounding that value as well as equivalent units of that value. For example, a dimension disclosed as "40 mm" is intended to mean "about 40 mm" as well as "1.58 inches". In addition, any dimensions and values disclosed herein accommodate successful use of the present invention with a variety of commercially available bags and receptacles. The disclosure of such dimensions and values, however, shall not preclude use of the present invention tool with customized bags and receptacles having dimensions and values outside of the prescribed ranges.

Certain features of the invention are also disclosed in US patent application publication 20110147545, the entire disclosure of which is expressly incorporated herein by reference thereto. In particular, the present invention includes additional features over the prior publication, including that the present device is readily fabricated from commercially available materials and is amenable for use with existing commercially available bags. The present device is also amenable for use in a variety of tasks, either alone or with one or more disposal bins that facilitate disposal of the contents retained by and transported in the held bags. Further, to the extent that any meaning or definition of a term in this document conflicts with any meaning or definition of the same term in the incorporated publication, the meaning or definition assigned to that term in this document shall govern.

While particular embodiments of the present invention have been illustrated and described, it is obvious to those skilled in the art that various changes can be made without departing from the spirit and scope of the invention. Accordingly, all expedient modifications readily attainable by one of ordinary skill in the art from the disclosure set forth herein, or by routine experimentation therefrom, are deemed to be within the spirit and scope of the invention as defined by the appended claims. It is therefore intended to cover all such changes and modifications that are within the scope of this invention in the appended claims.

What is claimed is:

1. A portable bag holder that maintains a bag mouth of a disposable bag in an open position, the bag holder comprising a handle having an elongate body depending therefrom and terminating in a bag mouth engaging portion for maintaining the bag mouth in the open position, with the bag mouth engaging portion including a frame that assists in maintaining the bag mouth in the open position for receiving contents therein, and with the bag mouth being removable from the bag mouth engaging portion to permit bag disposal after the contents are placed in the bag and to allow re-use of the bag mouth engaging portion on another bag, wherein, in use, the handle allows manipulation and placement of the holder and bag in any one of a plurality of positions to facilitate placing contents into the bag;

wherein the frame of the bag mouth engaging portion comprises:

a handle engaging portion proximate the elongate body of the handle and an opposed collection portion with opposed side portions intermediate the handle engaging portion and the collection portion, with the handle engaging portion, the collection portion and side portions releasably joined together by engagement means to delineate a rectangular ingress for receipt of the contents into a disposable bag; and a structure solely associated with the frame for releasable engagement with at least a portion of the bag mouth, wherein the structure comprises at least one latch in releasable engagement with each frame side portion, with each latch being configured and dimensioned to retain at least a portion of the bag mouth;

wherein the at least one latch is closable to retain at least the opposing sides of the bag mouth in the open position to receive contents in the bag, and openable to allow disposal of the bag after contents are placed therein, and to allow re-use of the at least one latch on another bag;

wherein each latch:

is further configured to releasably engage a corresponding aperture in a receptacle having an open end configured to correspond to the ingress of the frame when disposed adjacent thereto for receiving contents when the bag mouth is aligned with a periphery of the frame and is engaged by each latch to retain the opposing sides of the receptacle and at least a portion of the bag mouth together; and in use, each latch is configured to releasably engage the corresponding aperture in the receptacle so that closing each latch secures the opposing sides of the receptacle with the bag mouth being in the open position.

2. The portable bag holder of claim 1 which further comprises the receptacle, and with the handle engaging portion comprising a top of predetermined length, the collection portion comprising a bottom of predetermined length that exceeds the top length to facilitate guiding of the contents into the bag and the opposing sides being of predetermined height; wherein the receptacle has front and rear open ends with the bag mouth surrounding one of the open ends of the receptacle for receipt of the contents into the bag.

3. The portable bag holder of claim 2, wherein the receptacle includes a foldable flap to facilitate entry of contents into the bag when at least part of the bag mouth is in the open position.

4. The portable bag holder of claim 3, wherein the bag includes a drawstring having first and second ends and a length exceeding a periphery of the bag mouth, and wherein the drawstring is releasably engageable with an open end of the receptacle to retain the bag mouth in the open position.

5. The portable bag holder of claim 4, wherein:

the elongate body includes a drawstring securing structure that releasably secures at least part of the drawstring to allow disposal of at least one of the receptacle and the bag after contents are placed in at least one of the receptacle and bag, and to allow the holder to be re-used with another bag; and the latches releasably engage the bag mouth to retain the bag mouth in the open position.

6. The portable bag holder of claim 5, wherein the drawstring securing structure is a primary aperture defined in the elongate body and configured and dimensioned to receive at least one or both of the drawstring and bag mouth.

7. The portable bag holder of claim 1, wherein the handle includes a grasping portion having at least a partial opening to allow grasping by a user or hanging of the portable bag holder from a support.

8. A trash collecting kit comprising:

components for forming a portable bag mouth holder according to claim 1;

one or a plurality of bags of the same or different sizes, with the bags sized to be compatible with the frame.

9. A method for holding a disposable bag open, comprising:

providing a portable bag holder according claim 1; and securing at least part of the bag mouth of a disposable bag with the bag mouth engaging portion so as to maintain the bag mouth in the open position for receiving contents in the bag;

wherein the bag mouth is removable from the bag mouth engaging portion to permit bag disposal after contents are placed therein and to allow re-use of the bag mouth engaging portion on another bag; and wherein optionally the portable bag mouth holder and one or a plurality of receptacles are provided in a kit.

10. The portable bag holder of claim 1 wherein the releaseable engagement means comprises snaps, notch and recess engagement, or frictional engagement.

11. The portable bag holder of claim 1 further comprising means for detachable engagement of the handle and the handle engaging portion of the frame.

12. The portable bag holder of claim 11, wherein the detachable engagement means for joining the handle with the engaging portion comprises a threaded engagement, a frictional engagement, a snap-tight engagement, a notch and recess engagement.

13. The portable bag holder of claim 1, wherein the bag includes a drawstring having first and second ends and a length exceeding a periphery of the bag mouth, and wherein the drawstring is releasably engageable with the frame and handle to retain the bag mouth in the open position.

14. A portable bag holder that maintains a bag mouth of a disposable bag in an open position, the bag holder comprising:

a handle having an elongate body depending therefrom and terminating in a bag mouth engaging portion for maintaining the bag mouth in the open position, with the bag mouth engaging portion including a frame that assists in maintaining the bag mouth in the open position for receiving contents therein, and with the bag mouth being removable from the bag mouth engaging portion to permit bag disposal after the contents are placed in the bag and to allow re-use of the bag mouth engaging portion on another bag;

means for detachable engagement of the handle and the handle engaging portion of the frame, with the means comprising a threaded engagement, a frictional engagement, a snap-tight engagement, a notch and recess engagement;

wherein the frame of the bag mouth engaging portion comprises:

a rectangular shape with the handle engaging portion positioned proximate the elongate body of the handle, and an opposed collection portion with opposed side portions intermediate the handle engaging portion and the collection portion, with the handle engaging portion, the collection portion and side portions releasably joined together by snap-tight engagement means to delineate a rectangular ingress for receipt of the contents into a disposable bag; and a structure solely associated with the frame and integral therewith for releasable engagement with at least a portion of the bag mouth, wherein the structure comprises a plurality of elongated U-shaped members for engaging portions of the bag mouth therein, wherein the U-shaped members retain the bag mouth in the open position to receive contents in the bag, but allow removal and disposal of the bag after contents are placed therein, and to further allow re-use of the U-shaped members on another bag;

wherein the handle includes a grasping portion having at least a partial opening to allow grasping by a user, and wherein, in use, the handle allows manipulation and placement of the holder and bag in any one of a plurality of positions to facilitate placing contents into the bag.

15. A trash collecting kit comprising:

components for forming a portable bag mouth holder according to claim 14;

one or a plurality of bags of the same or different sizes, with the bags sized to be compatible with the frame.

16. A method for holding a disposable bag open, comprising:

providing a portable bag holder according claim 14; and securing at least part of the bag mouth of a disposable bag with the bag mouth engaging portion so as to maintain the bag mouth in the open position for receiving contents in the bag;

wherein the bag mouth is removable from the bag mouth engaging portion to permit bag disposal after contents are placed therein and to allow re-use of the bag mouth engaging portion on another bag; and wherein optionally the portable bag mouth holder and one or a plurality of receptacles are provided in a kit.

* * * * *